US007306266B2

(12) United States Patent
Hapke et al.

(10) Patent No.: US 7,306,266 B2
(45) Date of Patent: Dec. 11, 2007

(54) APPLIANCE LATCH HAVING A ROTATING LATCH HOOK MOUNTED ON A LINEAR SLIDE

(75) Inventors: Kenyon A. Hapke, Libertyville, IL (US); Jarod Michael Sulik, New Berlin, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 181 days.

(21) Appl. No.: 11/071,910

(22) Filed: Mar. 4, 2005

(65) Prior Publication Data

US 2005/0194795 A1 Sep. 8, 2005

Related U.S. Application Data

(60) Provisional application No. 60/550,526, filed on Mar. 5, 2004.

(51) Int. Cl.
*E05C 3/14* (2006.01)

(52) U.S. Cl. ..... 292/218; 292/192

(58) Field of Classification Search ..... 292/216, 292/218, 67, 71, 128, 192
See application file for complete search history.

(56) References Cited

U.S. PATENT DOCUMENTS

| | | | | |
|---|---|---|---|---|
| 775,524 | A * | 11/1904 | Deggim | 292/192 |
| 965,125 | A | 7/1910 | Terrell | |
| 1,932,829 | A * | 10/1933 | Parsons | 292/337 |
| 2,833,578 | A | 5/1958 | Burke | |
| 3,968,984 | A | 7/1976 | Guth | |
| 3,985,023 | A | 10/1976 | Guth | |
| 4,279,321 | A * | 7/1981 | Stone | 180/89.14 |
| 4,497,513 | A | 2/1985 | Sasaki | |
| 5,725,260 | A * | 3/1998 | Eikmeier et al. | 292/129 |
| 6,155,616 | A * | 12/2000 | Akright | 292/207 |
| 6,290,270 | B1 | 9/2001 | Spiessl | |
| 6,390,518 | B1 * | 5/2002 | Elick | 292/216 |
| 2002/0073752 | A1 * | 6/2002 | Dirnberger et al. | 70/266 |

FOREIGN PATENT DOCUMENTS

| | | |
|---|---|---|
| DE | 43 17 135 C1 | 9/1994 |
| DE | 43 43 975 C2 | 4/1997 |
| DE | 195 40 843 A1 | 5/1997 |
| DE | 19601228 A1 | 7/1997 |
| DE | 19837248 A1 | 2/2000 |
| EP | 1 217 117 A1 | 6/2002 |

* cited by examiner

*Primary Examiner*—Gary Estremsky
(74) *Attorney, Agent, or Firm*—Boyle Fredrickson, S.C.

(57) ABSTRACT

An appliance door latch provides a rotating hook supported on a linear carriage that may move along a line toward and away from a strike. A release of the strike from the rotating hook requires a compression of springs biasing the linear carriage which are then retained in a compressed state by a catch surface on the rotating hook. Re-engagement of the strike with the rotating hook releases the catch surface, causing the springs to pull the rotating hook and strike inward to aid in compressing a door gasket or the like.

22 Claims, 5 Drawing Sheets

APPLIANCE LATCH HAVING A ROTATING LATCH HOOK MOUNTED ON A LINEAR SLIDE

CROSS-REFERENCE TO RELATED APPLICATIONS

This application claims the benefit of provisional Patent Application 60/550,526 filed Mar. 5, 2004 hereby incorporated by reference.

STATEMENT REGARDING FEDERALLY SPONSORED RESEARCH OR DEVELOPMENT

Not Applicable

BACKGROUND OF THE INVENTION

The present invention relates to a latching mechanism for doors on household appliances and particularly to latching mechanisms that provide assistance in compressing a door gasket or the like.

Appliances such as dishwashers and front-loading washing machines may have an access door with a gasket that must be compressed to seal water within a washing chamber. Small area, highly compliant gaskets may be sealed by pressure from the user during the closing the door. The gasket may then be held in a compressed state by a latch mechanism.

Gaskets which require more force may be compressed by a latch mechanism having a lever operated by the user to engage a catch and draw the catch inward with a lever advantage to compress the gasket and hold the door shut.

A closing lever may be avoided in latch mechanisms that provide an "over-center" spring mechanism. During initial stages of closing of the door, closing force on the door is used to energize a spring. When the door closes past the over-center point, the spring releases its energy in a manner to pull the door fully closed. An example an over-center spring mechanism is described in U.S. Pat. No. 4,497,513 to Sasaki.

A variation on the over-center spring mechanism energizes the spring as the door is opened and holds that energy until the door is closed again. An over-center design is still employed and therefore a slight compression of the spring is required when the door is closed to release the energy. A latch of this kind is disclosed in U.S. Pat. No. 2,833,578 to Burke.

U.S. Pat. No. 6,290,270 to Spiessl shows a variation on Burke in which the latch spring is energized when the door is opened and held in the energized state by the rotation of a cam. When the door is closed, the cam is rotated by a strike to release the energized spring. This design reduces the force required to close the door by eliminating the need to compress an over-center spring mechanism during door closure.

In this latter design, the cam is held on a lever, and the energized spring moves the lever and cam. The spring engages the lever "outboard" of the cam to produce the necessary force over the needed distance with a manageable spring size. The lever in this design provides for a relatively narrow latch but increases the required height of the latch because of the necessary length of the lever and the outboard position of the spring. The lever is subject to significant bending forces making it difficult to implement the lever using injection molded thermoplastic, a material that is otherwise desirable in this application.

BRIEF SUMMARY OF THE INVENTION

The present invention provides a latch in which a locking cam is held on a carriage that slides linearly, preferably under the force of a series of balanced springs. By eliminating the need for a lever subject to high bending forces, the present invention provides a more compact design that may be readily implemented with injection-molded parts.

Specifically then, the present invention provides an appliance latch for retaining a strike and having a latch frame affixable to a portion of the appliance, for example, the door or appliance housing. A carriage slideably held by the latch frame moves along a line substantially parallel to an axis along which the latch receives the strike. At least one spring biases the carriage along this line in the direction from which the latch receives the strike. A rotating hook is supported by the carriage to move with the carriage and to rotate about an axis perpendicular to the line. The rotating hook rotates to capture a portion of the strike in a capture position when the strike enters the hook opening, and rotates to release the strike in a release position when the strike exits the hook opening. A catch holds the carriage in a first position along the line with the spring in a high state of compression when the rotating hook is in the release position and releases the carriage in a second position along the line with the spring in a lower state of compression when the rotating hook is in the capture position. In this way, energy stored in the spring when opening the latch is returned to aid in closing the latch.

It is thus one object of at least one embodiment of the invention to provide a low closing force, gasket-compressing latch in a compact mechanism.

Multiple compression springs may bias the carriage in a direction along which the latch receives the strike.

It is thus another object of at least one embodiment of the invention to distribute the force required for compression of the gasket among multiple springs, to reduce bending forces on the carriage and to simply manufacturing.

The multiple compression springs may be place symmetrically about the rotating hook, for example, at the corners of a rectangle surrounding the rotating hook.

Thus it is another object of at least one embodiment of the invention to allow the springs to placed close to the hook to reduce shear on the carriage, facilitating the manufacture of the carriage from thermoplastic to provide reduced manufacturing cost, weight, and noise, and improved lubricity and resistance to water.

The carriage may slide on rails fixed with respect to the latch frame and the compression springs may symmetrically flank each rail.

Thus it is another object of at least one embodiment of the invention to provide a simple method of balancing the forces on the carriage to reduce binding.

The rotating hook may include a cam surface compressed by the spring against a stop fixed with respect to the latch frame and the cam surface may have a high radius portion holding the carriage in the first position when the rotating hook is in the release position and the low radius portion releasing the carriage to a second position along the line with the spring in a lower state of compression when the rotating hook is in the capture position.

It is thus another object of at least one embodiment of the invention to provide a simple mechanism for releasing the spring energy when the door is closed with minimal closing force.

The stop may be a rod extending between the rails along which the carriage slides.

Thus it is another object of at least one embodiment of the invention to align the force of the stop with the slides of the carriage to reduce binding and to provide dual use for the rails which both hold the stop and support the carriage for sliding.

The appliance latch may further include a lock having a locked and unlocked state, the lock preventing the strike from exiting the latch when the lock is in the locked state.

Thus, it is another object of at least one embodiment of the invention to provide the ability to lock the door from opening at certain times, for example, for safety purposes.

The lock, in the locked state, may position a blocking member between the strike and structure fixed with respect to the latch frame so that a disengaging force on the strike does not place substantial force on the rotating hook or carriage.

It is thus another object of at least one embodiment of the invention to provide a lock that shields the hook and carriage from potentially high disengaging forces allowing both to be constructed from thermoplastics.

The lock may include a lock stop preventing the lock from moving to the locked state when the strike has not engaged the hook. The lock stop, for example, may be attached to the carriage to interfere with a sliding lock bar of the lock when the carriage is in a first position and the lock stop may be spring loaded to allow some movement of the carriage under forces from the strike when the carriage is in the first position and the lock is in the locked state.

Thus it is another object of at least one embodiment of the invention to provide a lock that cannot be inadvertently activated when the door of the appliance is not fully closed and which may be simply incorporated into the linear carriage.

A spring may be incorporated into the latch to bias the rotating hook toward the release position.

It is thus another object of at least one embodiment of the invention to ensure that the rotating hook is properly positioned to receive the latch in the event frictional contact is lost between the rotating hook and the stop with jarring or vibration.

The spring may be a leaf spring pressing against a surface of the rotating hook.

It is thus another object of at least one embodiment of the invention to avoid the need for torsion springs that can be difficult to position in manufacturing.

These particular objects and advantages may apply to only some embodiments falling within the claims and thus do not define the scope of the invention.

DETAILED DESCRIPTION OF THE PREFERRED EMBODIMENT

Figure 1:
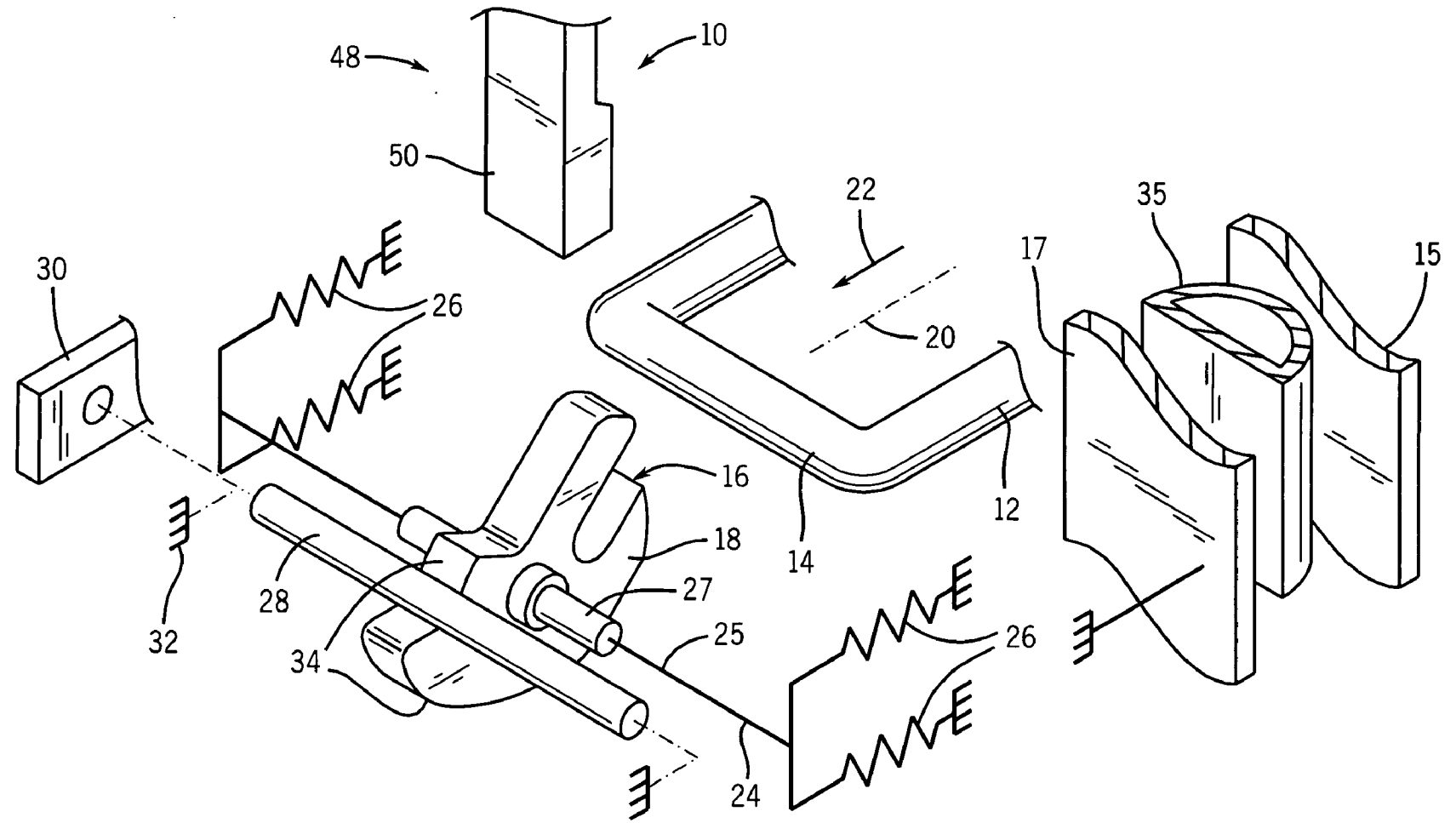
FIG. 1 is a perspective view of the principal components of the latch of the present invention providing a linear carriage (abstracted for clarity) biased on springs and supporting a rotating hook abutting a stop to engage a strike.

Referring now to FIG. 1, an appliance latch 10 of the present invention works with a strike 12, in this case, a U-shaped rod having a laterally extending strike bar 14. The strike 12, may be attached to a first portion 15 of an appliance, for example the appliance door, to be received by the appliance latch 10 attached to a second portion 17 of the appliance, for example, the appliance housing against which the door is closed.

The strike bar 14 of the strike 12 may engage a hook opening 16 of a rotating hook 18. The rotating hook 18 rotates on axle 27 about an axis 25 generally perpendicular to axis 20 and may receive the strike along an axis 20 in a direction 22.

The rotating hook 18 is mounted to a linear carriage 24 of the appliance latch 10. The linear carriage 24 is supported on a plurality of springs 26 to move in a line substantially along axis 20. The springs 26, which may be helical compression springs, urge the linear carriage 24 along direction 22.

A stop 28 is positioned behind the rotating hook 18 with respect to the strike 12 and may be a laterally extending metal bar generally perpendicular to axis 20. The stop 28 limits translative motion of the rotating hook 18 in direction 22 through interference between the stop 28 and cam surfaces 34 at the radial outer periphery of the rotating hook 18. The stop 28 may also prevent rotation of the rotating hook 18 under certain circumstances to be described below.

The stop 28 is held fixed by a pair of rails 30 (only one shown in FIG. 1) with respect to a latch frame 32 attached to the second portion 17 of the appliance. The rails 30 also provide a sliding support for the linear carriage 24.

Figure 5:
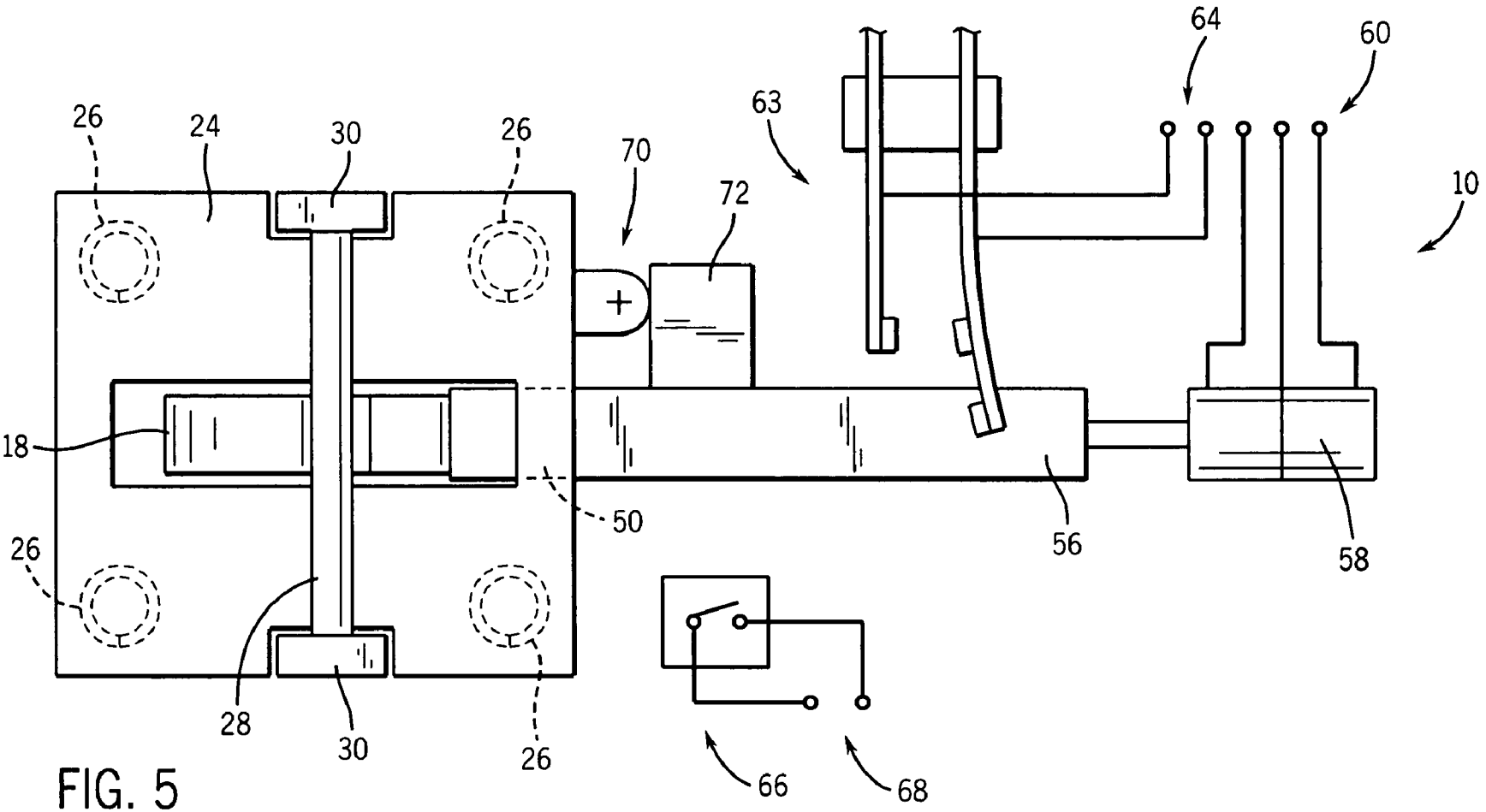
FIG. 5 is a front elevational view of the lock mechanism that may be used with the latch of the present invention showing electrical connections to a door close switch, a locking state switch and a bi-directional actuator.

Referring momentarily to FIG. 5, the rotating hook 18 may be positioned approximately in the center of the linear carriage 24 and the springs 26 placed at comers of a rectangle circumscribing the rotating hook and symmetrically flanking about the axis of the rotating hook 18 and the rails 30 on which the linear carriage 24 rides to eliminate problems of binding or the like.

Figure 2:
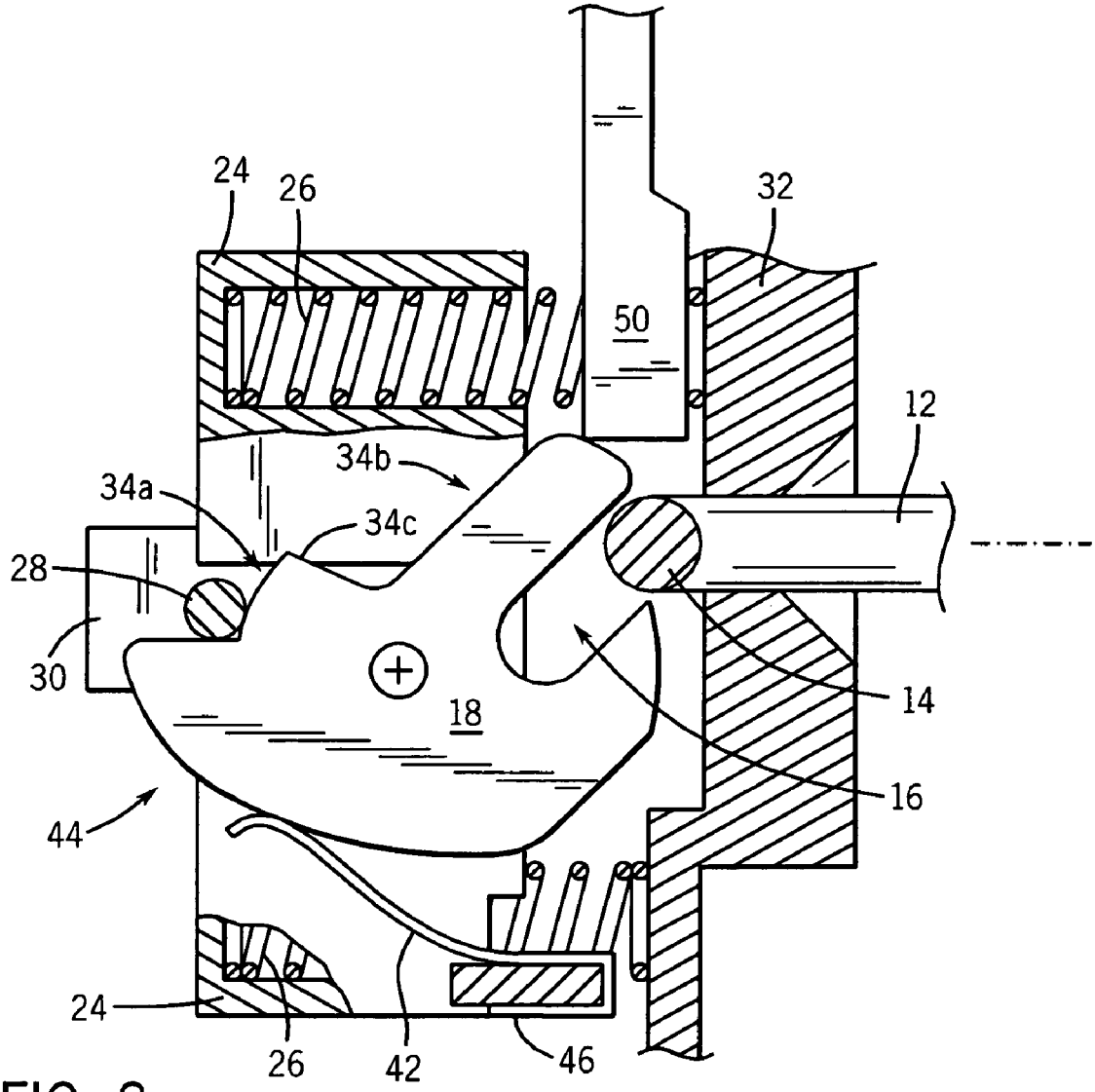
FIG. 2 is a cross-sectional view along line 2—2 of FIG. 1 showing the components of FIG. 1 assembled on the linear carriage in a first position with springs in a high state of compression and the rotating hook in the release position prior to receiving the strike.
Figure 4:
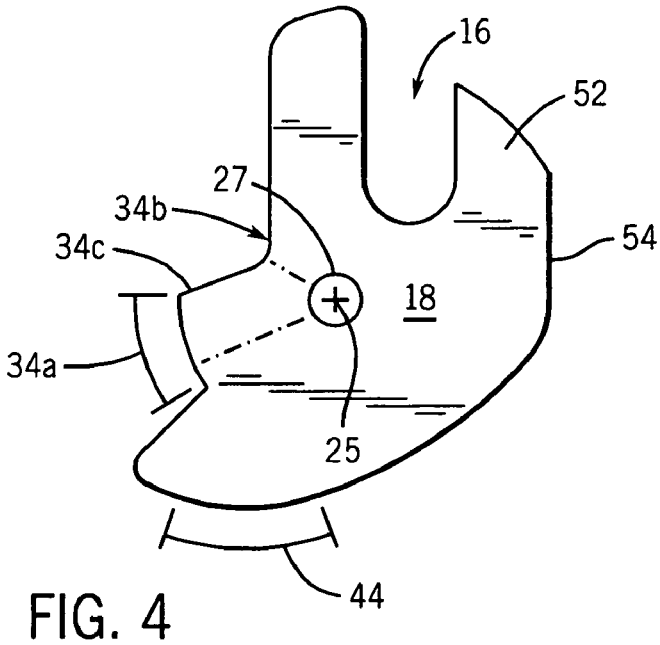
FIG. 4 is a view of the rotating hook showing its cam surfaces.

Referring now to FIGS. 2 and 4, before the rotating hook 18 has fully received the strike 12, the linear carriage 24 will be in a first state with springs 26 highly compressed and the linear carriage 24 moved fully forward in a direction opposite direction 22. The linear carriage 24 is and held in this position with the springs 26 fully compressed by contact of a high-radius cam surface 34*a* of the rotating hook 18 with the stop 28 held by the rail 30.

When strike bar 14 of the strike 12 engages the hook opening 16 it causes a counterclockwise rotation 23 of the rotating hook 18 about axis 25. This causes high-radius cam surface 34*a* to move away from stop 28 to be replaced by low-radius cam surface 34*b*. Low-radius cam surface 34*b* allows the rotating hook 18 to move in direction 22 under the urging of the springs 26. The backward movement of the rotating hook 18 draws along with it the strike 12 pulling the first portion 15 and second portion 17 of the appliance (shown in FIG. 1) about a gasket 35.

Figure 3:
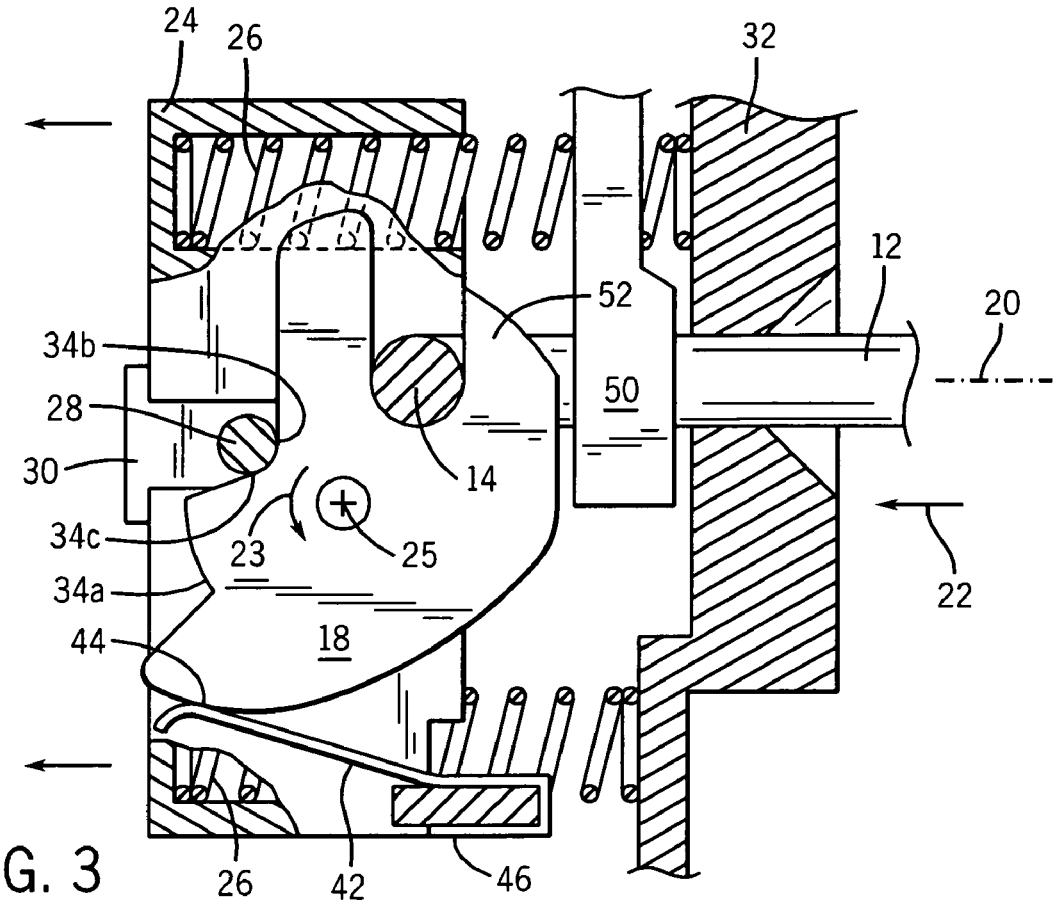
FIG. 3 is a figure similar to that of FIG. 2 showing the carriage in a second position with the springs in a lower state of compression and the rotating hook in the capture position.

The springs 26 are sized to compress the gasket 35 into a sealing condition. Resistance of the gasket 35 to compression causes the rotating hook 18 to experience a clockwise force as the rotating hook 18 pulls against the strike 12. Referring to FIGS. 3 and 4, this clockwise force on the rotating hook 18 is resisted by a radially-extending cam surface 34*c* positioned between the high-radius cam surface 34*a* and the low-radius cam surface 34*b* which blocks clockwise motion of the rotating hook 18 once the linear carriage 24 has moved along direction 22 away from its first position.

Referring now to FIGS. 1, and 3, when the linear carriage 24 has fully moved backwards in direction 22, into a second position with the springs 26 extended in a lower state of compression, the gasket 35 will be compressed into a sealed state and at equilibrium with springs 26.

When it is desired to open the door, a force may be applied to the strike 12 in a direction opposite direction 22. Initially, this force draws the rotating hook 18 and the linear carriage 24 forward without rotation of the rotating hook 18 compressing springs 26. Rotation of the rotating hook 18 is prevented by interference between stop 28 and radially-extending cam surface 34*c*.

When the linear carriage 24 is pulled fully forward, the radially extending cam surface 34 moves beyond the stop 28 and the rotating hook 18 is free to rotate in a clockwise direction, releasing the strike 12. Rotation of the rotating hook 18 brings high-radius cam surface 34*a* back into contact with the stop 28 holding the linear carriage 24 inward by means of interfitting of stop 28 and high-radius cam surface 34*a*.

Referring again to FIGS. 2 through 4, generally free rotation of the rotating hook 18, absent force from the strike 12, is prevented by frictional contact between the stop 28 and the high-radius cam surface 34*a* or low-radius cam surface 34*b*. Optionally, however, a restoring clockwise torque may be exerted on the hook 18 by a leaf spring 42 to ensure that the rotating hook 18 stays a fully clockwise position with jarring or vibration. The leaf spring 42 has one end attached to the linear carriage 24 and the other end pressing radially inward against a spiral cam surface 44 so that the inward pressing of the leaf spring 42 provides a slight clockwise bias to the rotating hook 18 preventing it from being misaligned during closing of the appliance door per FIG. 2. The end of the leaf spring 42 attached to the linear carriage 24 may have a hook end 46 allowing it to be snapped in place onto the linear carriage 24 after assembly of the rotating hook 18 to the linear carriage 24. This design eliminates the need to install a torsion spring in compression around the axle 27 of the rotating hook 18 such as may prove difficult in manufacture.

Referring now to FIG. 1, at times it may be desirable to prevent an opening of the appliance door simply by pulling on the door and accordingly, the present invention provides for lock 48 providing a bolt 50 shown in FIGS. 1, 2 and 3 that may move between the latch frame 32 and the strike bar 14 when the appliance latch 10 is closed with the linear carriage 24 in the second position holding the door shut. Opening force (opposite direction 22) on the strike 12 pulls a lower lip 52 of the opening 16 of the hook 18 against the bolt 50 so that the rearward flat surface of the bolt 50 abuts a flat cam surface 54 of the lower lip 52. Force on the rotating hook 18 by the strike 12 pulls the flat surface of the lower lip 52 against the flat surface of the bolt 50 so that the lower lip 52 is captured between strike bar 14 and bolt 50 with no net torque being exerted on the rotating hook 18 about axis 25. Accordingly, the rotating hook 18 need not be able to withstand high shear forces exerted on the hook opening 16 by the strike bar 14. Further, because force from the strike 12 is channeled into compression of the lower lip 52 excessive force is not applied to the linear carriage 24. This permits the hook 18 and linear carriage 24 to be molded of common thermoplastic materials which provide high compression strength.

The front surface of the bolt 50 away from the rotating hook 18 is fully supported by the latch frame 32 and ultimately the structure of the appliance housing or door on which the latch frame is mounted so that the bolt 50 also experiences primarily compressive as opposed to bending forces. For this reason, the bolt 50 may also be molded of common thermoplastic materials.

Referring to FIG. 5, the bolt 50 may be attached to a slide 56 driven by a bi-directional solenoid 58 of type well-known in the art according to electrical signals provided to terminals 60. The bi-directional solenoid may move the slide 56 to either of two lateral positions to push the bolt 50 leftward into position under the rotating hook 18 (per FIG. 3) or to retract the bolt 50 rightward (as shown in FIGS. 2 and 5).

A pair of contacts 63 may communicate with the slide 56 to provide a signal through terminals 64 indicating that the bolt 50 is positioned to block the retraction of the strike 12 and a push button door closure switch 66 provides a signal that the door is closed through terminals 68. Accordingly, a control circuit (not shown) attached to the terminals 60, 64 and 68 may enforce a sequence of operations of the appliance latch 10 allowing the bolt 50 to be moved leftward to lock the appliance latch 10 only when the door is closed as indicated by switch 66 and to allow starting of the appliance only after confirmation of that locking has occurred per contacts 63.

Figure 6:
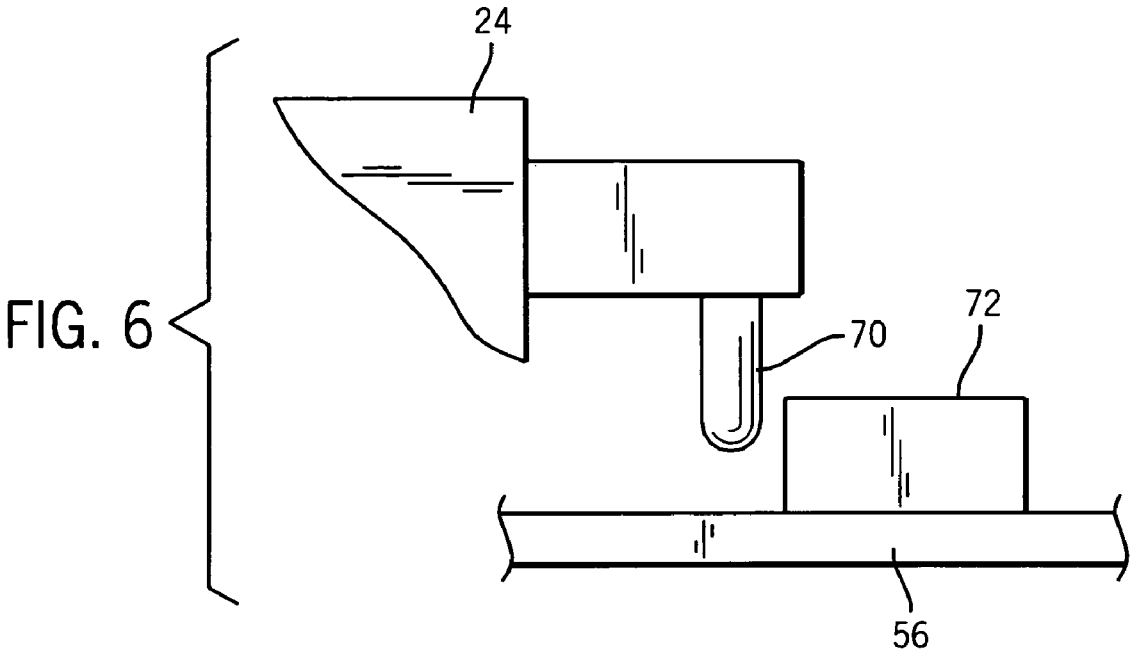
FIGS. 6 and 7 are fragmentary side views of the stop of FIG. 5 showing the spring-loaded plunger providing a lock stop preventing locking when the linear carriage is in the first position.

Referring to FIGS. 5 and 6, the slide 56 may include a projection 72 extending from the slide 56 in a direction perpendicular to the slide that may engage a spring-loaded lock stop 70 to prevent locking of the appliance latch 10 when the linear carriage 24 has not fully retracted to the second position. When the linear carriage 24 is in the first position, as shown in FIG. 6, with the springs 26 in a high state of compression, the lock stop 70 interferes with movement of the slide 56 leftward to a locking position by interference between projection 72 and the lock stop 70. When the linear carriage 24 moves to the second position, as shown in FIG. 7, the lock stop 70 also moves upward allowing passage of projection 72 and leftward movement of the slide 56.

Figure 7:
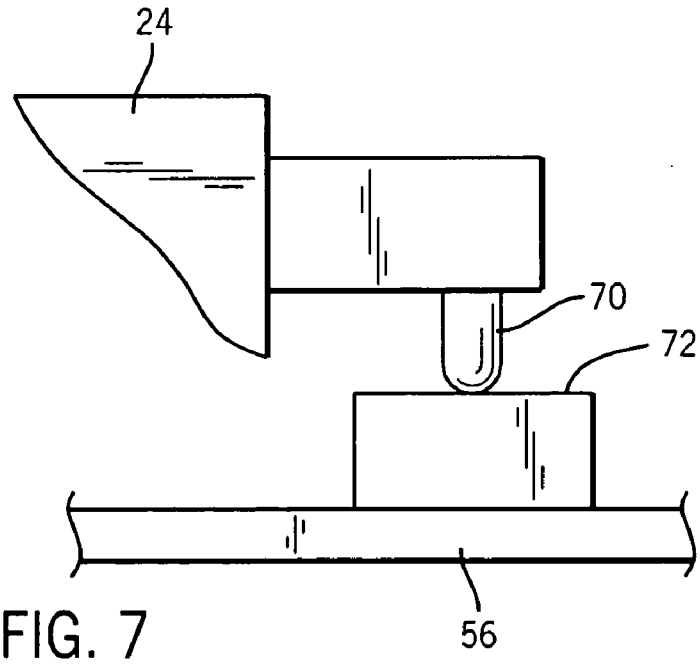

As shown in FIG. 7, when the slide 56 is in the leftward position and thus the appliance latch 10 is locked, the linear carriage 24 may be moved slightly by an attempted opening of the door. The lock stop 70 is spring loaded so as to retract slightly in this case, against the projection 72. The lock stop 70 prevents the appliance latch 10 from being activated when the appliance latch 10 is not fully engaged and yet allows the linear carriage 24 to move slightly within a predefined range when it is in a locked condition.

It is specifically intended that the present invention not be limited to the embodiments and illustrations contained herein, but include modified forms of those embodiments including portions of the embodiments and combinations of elements of different embodiments as come within the scope of the following claims.

We claim:

1. An appliance latch for retaining a strike, the latch comprising:

a latch frame affixable to a portion of the appliance;

a carriage slideably held by the latch frame to move along a line substantially parallel to an axis along which the latch receives the strike;

at least one spring biasing the carriage along the line in a direction which the latch receives the strike;

a rotating hook supported by the carriage to move with the carriage and to rotate about an axis perpendicular to the line, the rotating hook rotating to capture a portion of the strike in a capture position when the strike enters a hook opening and rotating to release the strike in a release position when the strike exits the hook opening;

a catch holding the carriage in a first position along the line with the spring in a high state of compression when the rotating hook is in the release position and releasing the carriage to a second position along the line with the spring in a lower state of compression when the rotating hook is in the capture position;

whereby energy stored in the spring in opening the latch is returned to aid in closing the latch;

wherein multiple compression springs bias the carriage in a direction along which the latch receives the strike and the multiple compression springs are placed at corners of a rectangle surrounding the rotating hook.

2. The appliance latch of claim 1 wherein the multiple compression springs are placed symmetrically about the rotating hook.

3. The appliance latch of claim 1 wherein the rotating hook includes a cam surface pressed by the spring against a stop fixed with respect to the latch frame, and wherein the cam surface has a high radius portion holding the carriage in the first position when the rotating hook is in the release position and a low radius portion releasing the carriage to a second position along the line with the spring in a lower state of compression when the rotating hook is in the capture position.

4. The appliance latch of claim 3 wherein the carriage slides on two rails fixed with respect to the latch frame and opposed along an axis of rotation of the rotating hook and wherein the stop is a rod extending between the rails.

5. The appliance latch of claim 3 wherein the cam surface further includes a radial stop wall dividing the high radius portion from the low radius portion of the cam surface and wherein the carriage must be moved to the first position with the spring in a high state of compression before the radial stop wall can disengage from the stop allowing the rotating hook to move to the release position.

6. The appliance latch of claim 1 wherein the latch frame is affixed to a first portion of the appliance and the strike is affixed to a second portion of the appliance further including a gasket positioned between the first and second portions of the appliance and wherein the at least one spring is sized to compress the gasket into a sealing condition when the carriage is in the second position.

7. An appliance latch for retaining a strike, the latch comprising:

a latch frame affixable to a portion of the appliance;

a carriage slideably held by the latch frame to move along a line substantially parallel to an axis along which the latch receives the strike;

at least one spring biasing the carriage along the line in a direction which the latch receives the strike;

a rotating hook supported by the carriage to move with the carriage and to rotate about an axis perpendicular to the line, the rotating hook rotating to capture a portion of the strike in a capture position when the strike enters a hook opening and rotating to release the strike in a release position when the strike exits the hook opening;

a catch holding the carriage in a first position along the line with the spring in a high state of compression when the rotating hook is in the release position and releasing the carriage to a second position along the line with the spring in a lower state of compression when the rotating hook is in the capture position;

whereby energy stored in the spring in opening the latch is returned to aid in closing the latch;

wherein the carriage slides on rails fixed with respect to the latch frame and wherein two compression springs symmetrically flank each rail.

8. An appliance latch for retaining a strike, the latch comprising:

a latch frame affixable to a portion of the appliance;

a carriage slideably held by the latch frame to move linearly without rotation substantially parallel to an axis along which the latch receives the strike; wherein the carriage slides on rails fixed with respect to the catch frame at least one spring biasing the carriage along the line in a direction which the latch receives the strike;

a rotating hook supported by the carriage to move with the carriage and to rotate about an axis perpendicular to the line, the rotating hook rotating to capture a portion of the strike in a capture position when the strike enters a hook opening and rotating to release the strike in a release position when the strike exits the hook opening;

a catch holding the carriage in a first position along the line with the spring in a high state of compression when the rotating hook is in the release position and releasing the carriage to a second position along the line with the spring in a lower state of compression when the rotating hook is in the capture position;

whereby energy stored in the spring in opening the latch is returned to aid in closing the latch and wherein the carriage is injection molded thennoplastic.

9. An appliance latch for retaining a strike, the latch comprising:

a latch frame affixable to a portion of the appliance;

a carriage slideably held by the latch frame to move along a line substantially parallel to an axis along which the latch receives the strike;

at least one spring biasing the carriage along the line in a direction which the latch receives the strike;

a rotating hook supported by the carriage to move with the carriage and to rotate about an axis perpendicular to the line, the rotating hook rotating to capture a portion of the strike in a capture position when the strike enters a hook opening and rotating to release the strike in a release position when the strike exits the hook opening;

a catch holding the carriage in a first position along the line with the spring in a high state of compression when the rotating hook is in the release position and releasing the carriage to a second position along the line with the spring in a lower state of compression when the rotating hook is in the capture position;

whereby energy stored in the spring in opening the latch is returned to aid in closing the latch further including a lock having a locked and unlocked state, the lock preventing the strike from exiting the latch when the lock is in a locked state.

10. The appliance latch of claim 9 wherein the lock in the locked state positions a blocking member between the strike and structure fixed with respect to the latch frame so that a disengaging force on the strike does not turn the rotating hook.

11. The appliance latch of claim 10 wherein the blocking member is molded thermoplastic.

12. The appliance latch of claim 9 wherein the lock in the locked state positions a blocking member between a portion of the rotating hook and structure fixed with respect to the latch frame so that a disengaging force on the strike does not place substantial force on the carriage.

13. The appliance latch of claim 9 wherein the lock is driven by an electromagnetic actuator.

14. The appliance latch of claim 9 wherein the lock communicates with at least one electrical switch providing a signal indicating whether the lock is in the locked state.

15. The appliance latch of claim 9 further including a lock stop preventing the lock from moving to the locked state when the strike has not engaged the hook.

16. The appliance latch of claim 15 wherein the lock stop is attached to the carriage to interfering with a sliding lock bar of the lock when the carriage is in the first position.

17. The appliance latch of claim 16 wherein the lock stop is spring loaded to allow some movement of the carriage under forces from the strike when the carriage is in the first position and the lock is in the locked state.

18. The appliance latch of claim 9 further including an electrical switch indicating that the strike has engaged the hook.

19. The appliance latch of claim 9 further including a spring biasing the rotating hook to a toward the release position.

20. The appliance latch of claim 19 wherein the spring is a leaf spring pressing against a surface of the rotating hook.

21. The appliance latch of claim 9 wherein the rotating hook is molded thermoplastic.

22. The appliance latch of claim 9 wherein the frame is molded thermoplastic.

* * * * *